US005149573A

United States Patent [19]

Kobe et al.

[11] Patent Number: 5,149,573

[45] Date of Patent: Sep. 22, 1992

[54] HIGHLY TRANSPARENT STRIP MATERIAL USED FOR FORMING FASTENERS

[75] Inventors: James J. Kobe; Susan K. Nestegard, both of St. Paul, Minn.

[73] Assignee: Minnesota Mining and Manufacturing Company, St. Paul, Minn.

[21] Appl. No.: 531,869

[22] Filed: Jun. 1, 1990

[51] Int. Cl.[5] ..... A44B 17/00; A44B 18/00; B32B 3/06

[52] U.S. Cl. ..... 428/93; 428/95; 428/99; 428/100; 24/448

[58] Field of Search ..... 24/448; 428/93, 95, 428/99, 100

[56] References Cited

U.S. PATENT DOCUMENTS 4,322,875 4/1982 Brown et al. ..... 24/204

OTHER PUBLICATIONS

"Scotch TM VHT TM" Joining Systems 4910 Brochure Published by Industrial Specialties Division/3M, 220-73 3M Center, St. Paul, Minnesota 55144 dated Mar. 1989.

Product Information Scotch TM VHB TM Joining Systems published by 3M Industrial Specialties Division, 3M Center, Bldg. 220-7E, St. Paul, MN 55144 dated Jan. 1990.

*Primary Examiner*—George F. Lesmes
*Assistant Examiner*—D. R. Zirker
*Attorney, Agent, or Firm*—Gary L. Griswold; Walter N. Kirn; William L. Huebsch

[57] ABSTRACT

A strip material from which a portion may be severed to form a portion of a fastener. The strip material comprising a polymeric bonding layer; a multiplicity of flexible, resilient, generally U-shaped monofilaments, each monofilament including a central elongate bight portion embedded in the bonding layer, two stem portions extending from the opposite ends of the bight portion and projecting generally normal to an exposed major surface of the bonding layer, and enlarged heads at the ends of the stem portions opposite the bight portion, resiliently elastic material attached to the surface of the bonding layer opposite its exposed major surface, and pressure sensitive adhesive means along an attachment surface of the resiliently elastic material opposite the bonding layer for adhering the strip material to a substrate. The combination of the bonding layer, the monofilaments, the layer of resiliently elastic material and the pressure sensitive adhesive means are highly transparent when viewed from an angle at which the exposed major surface of the bonding layer can be seen after strip material is adhered to a substrate so that the color of the substrate will be fairly clearly seen through the strip material.

6 Claims, 1 Drawing Sheet

HIGHLY TRANSPARENT STRIP MATERIAL USED FOR FORMING FASTENERS

TECHNICAL FIELD

This invention relates to strip materials that have headed projections so that portions of the strip materials will engage themselves or portions of different strip materials to provide a releasable fastener that may be used between different objects.

BACKGROUND OF THE INVENTION

U.S. Pat. No. 4,290,174 describes such a strip material which comprises a flexible polymeric bonding layer; a multiplicity of flexible, resilient, generally U-shaped monofilaments of polymeric material, each including a central bight portion embedded in the bonding layer in an array, two stem portions extending from the bight portion and projecting generally normal to an exposed major surface of the bonding layer; and enlarged, generally circular heads at the distal ends of the stem portions.

Fasteners can be made from two portions cut from the strip material described in U.S. Pat. No. 4,290,174 in which case the headed stems releasably engage each other, or from one portion used in combination with a different fastener portion such as one having a field of loops adapted to be engaged by the the headed stems.

U.S. Pat. No. 4,216,257 describes making such a strip material that includes a layer of low density resiliently elastic foam adhered to the surface of the bonding layer opposite its exposed major surface, and a layer of a soft tacky pressure-sensitive adhesive on the surface of the layer of foam opposite the bonding layer, which layers of foam and adhesive under many circumstances help in securely attaching the strip material to an object and help engagement of a portion of the strip material with another fastener portion.

U.S. Pat. No. 4,322,875 describes making fasteners from portions of two different strip materials having rectangular arrays of headed stems, each of which strip materials has stem portions that are about equally spaced in each direction to provide numbers of stem portions per unit length along the surface of its bonding layer in each direction that are different from and not a multiple of or evenly divisible by the number of stem portions per unit length on the other strip material in either direction to provide both a desired useful level of engagement and disengagement forces between the portions of the two strip materials and to restrict relative movement between the portions of the strip materials in directions parallel to their bonding layers when the fastener portions are engaged so that the rows of their headed stems are parallel.

While fastener portions cut from all of the strip materials described above have been found to be useful for some purposes, heretofore at least some of the materials from which these strip materials have been made has been mostly opaque and of a color that may not be the same as objects to which fastener portions from the strip materials may be attached, so that the fastener portions can detract from the appearance of some objects on which they are attached.

DISCLOSURE OF THE INVENTION

According to the present invention there is provided a strip material generally of the types described above from which fastener portions can be made which can be attached to a substrate of any color or combination of colors, and will allow an observer to fairly clearly see that color or those colors through the fastener portion to greatly reduce the amount that the presence of the fastener portion will detract from the appearance of the substrate when compared with fastener portions that are mostly opaque.

The strip material according to the present invention, like the strip material described in U.S. Pat. No. 4,216,257, comprises a polymeric bonding layer; a multiplicity of flexible, resilient, generally U-shaped monofilaments each including a central bight portion embedded in the bonding layer and two stem portions extending from the opposite ends of the bight portion and projecting generally normal to an exposed major surface of the bonding layer; enlarged, generally circular heads at the ends of the stem portions opposite the bight portion, resiliently elastic material attached to the surface of the bonding layer opposite its exposed major surface, and pressure sensitive adhesive means along an attachment surface of the resiliently elastic material opposite the bonding layer for adhering the strip material to a substrate.

Unlike the strip material described in U.S. Pat. No. 4,216,257, however, in the strip material according to the present invention the combination of the bonding layer, the monofilaments, the layer of resiliently elastic material and the pressure sensitive adhesive means are highly transparent when viewed from an angle at which the exposed major surface of the bonding layer can be seen after strip material is adhered to a substrate so that the color of the substrate will be fairly clearly seen through the strip material. This causes the presence of a fastener portion from the strip material according to the present invention to be far less noticeable and objectionable than it can be when it is a different color than the substrate, and produces this effect without the necessity of matching the color of the fastener portion to the color of the substrate.

By "highly transparent strip material" we mean strip material of the type described above that when adhered to a substrate by the pressure sensitive adhesive means has an opacity of less than about 25% when measured in accordance with test method described below. A preferred transparent strip material has been found to have about 60% the light transmission of clear glass, and to have, when it is adhered to a substrate by the layer of pressure sensitive adhesive, an opacity of only about 16.5% when measured in accordance with test methods described below.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
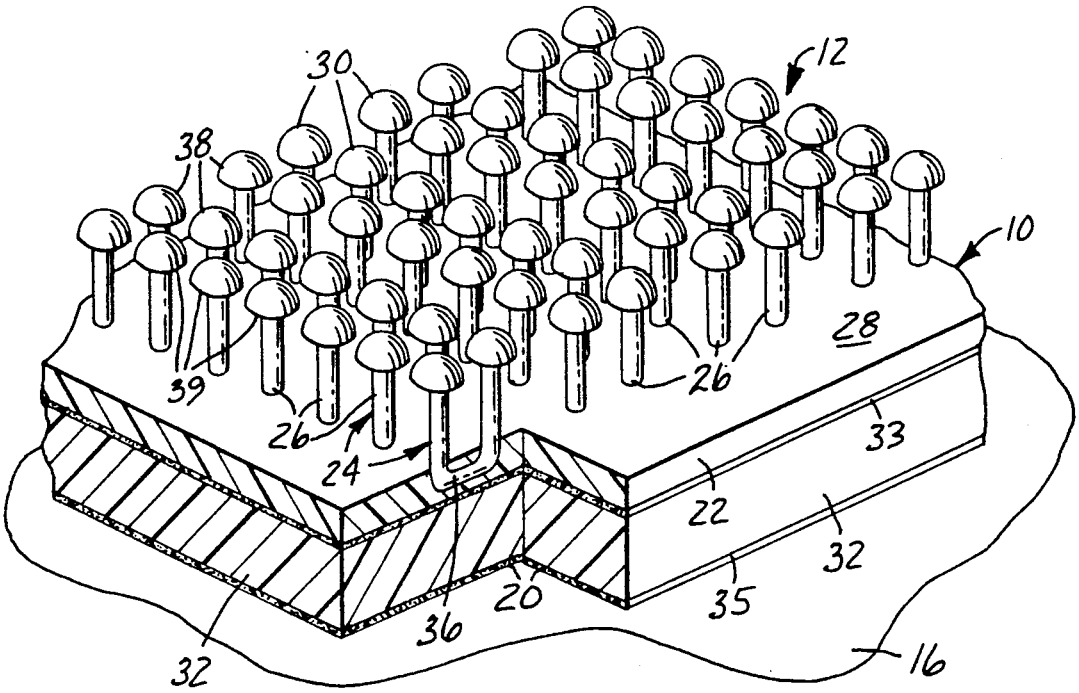
FIG. 1 is a fragmentary perspective view of a first embodiment of a strip material according to the present invention.

Referring now to FIG. 1 of the drawing there is shown in FIG. 1 a portion 10 of an elongate strip material 12 according to the present invention, which portion 10 is illustrated adhered to the surface of an object 16 by pressure sensitive adhesive means so that the portion 10 can serve as part of a fastener attaching a second object (not shown) to the object 16. The portion 10 of the strip material 12 is highly transparent when viewed from an angle at which an exposed major surface 28 of a bonding layer 22 included in the strip material 12 can be seen after the portion 10 is adhered to the object 16 so that the color or colors of the object 16 will be fairly clearly seen through the portion 10 of the strip material 12.

The strip material 12 comprises the bonding layer 22 which is of highly transparent material and in which are embedded a plurality of highly transparent, flexible, resilient, generally U-shaped monofilaments 24. The monofilaments 24 have stem portions 26 that project from the exposed major surface 28 of the bonding layer 22 and have heads 30 at their distal ends. The bonding layer 22 and the method by which the monofilaments 24 are embedded in the bonding layer 22 are described in greater detail in U.S. Pat. No. 4,290,174, the content whereof is incorporated herein by reference. Also, the strip material 12 includes a layer 32 of highly transparent viscoelastic material adhered to a surface of the bonding layer 22 opposite the exposed major surface 28 and having an attachment surface 35 opposite the bonding layer 22, and pressure sensitive adhesive means provided by a layer 20 of soft tacky highly transparent pressure-sensitive adhesive along the attachment surface 35 for adhering the strip material 12 to a substrate such as the object 16. As illustrated, the layer 32 of viscoelastic material is adhered to the surface of the bonding layer 22 opposite the surface 28 by a layer 33 of highly transparent adhesive which may be similar to or of the same material as the layer 20 of adhesive, however, alternatively the layer 32 of viscoelastic material may have sufficient adhesive properties that with an appropriate primer on the bonding layer 22, the layer 32 of viscoelastic material may adhere directly thereto.

In a preferred embodiment of the strip material 12, the bonding layer 22 in which the U-shaped monofilaments 24 are embedded is of the uniform non-fibrous, non-oriented transparent polymeric material commercially designated "Eastman polyallomer 5321E that is available from Eastman Chemical Co., Longview, Texas, and has a predetermined thickness of about 0.051 centimeter (0.020 inch) adapted to receive bight portions 36 of the U-shaped monofilaments 24. The U-shaped monofilaments have a diameter of about 0.381 millimeter (0.015 inch) and are formed of a longitudinally oriented transparent polypropylene polymeric material available from Shakespeare Monofilament Co., Columbia, S.C. The stem portions 26 of each monofilament 24 are of essentially the same 2.286 millimeter (0.09 inch) length, project at generally a right angle from the surface 28 of the bonding layer 22 and extend from the ends of an embedded bight portion 36 of the monofilament 24. The heads 30, have diameters of about 0.99 millimeter (0.039 inch), and have arcuate, generally semi-spherical cam surfaces 38 opposite the bonding layer 22, and the stem portions 26 in the strip material can be disposed, as described above, so that the cam surfaces 38 of the heads 30 on one portion 10 severed from the strip material 12 can engage the cam surfaces 38 on the heads 30 of the other portion 10 severed from the strip material to produce the necessary side deflection of the stem portions 26 upon movement of the heads 30 toward each other with the bonding layers 22 generally parallel so that the heads 30 may pass to engage the portions 10 of the strip material 12. Also, the heads 30 on the portion 10 of the strip material 12 each have a generally planar latching surface 40 extending radially outwardly of its supporting stem portion 26, which latching surface 40 is adapted to either engage loops from another fastener portion, or the latching surface 40 on one or more of the heads 30 of the other strip material 12 to retain the heads 30 in engagement until a predetermined force is applied to separate them. The layer 33 of transparent pressure-sensitive adhesive is a 0.05 millimeter (0.002 inch) thick coating of the acrylic pressure sensitive adhesive commercially designated "Y-9460PC" commercially available from Minnesota Mining and Manufacturing Co., St. Paul, Minn.; the layer 32 of transparent viscoelastic material is a 0.889 millimeter (0.035 inch) thick layer of the acrylic material commercially designated "Scotch VHB 4910" also commercially available from Minnesota Mining and Manufacturing Co.; and the layer of transparent pressure-sensitive adhesive 20 is a 0.05 millimeter (0.002 inch) thick coating of the acrylic adhesive commercially designated "Scotch Brand A-35 Adhesive Transfer Tape F-9752PC" also commercially available from Minnesota Mining and Manufacturing Co.

Figure 2:
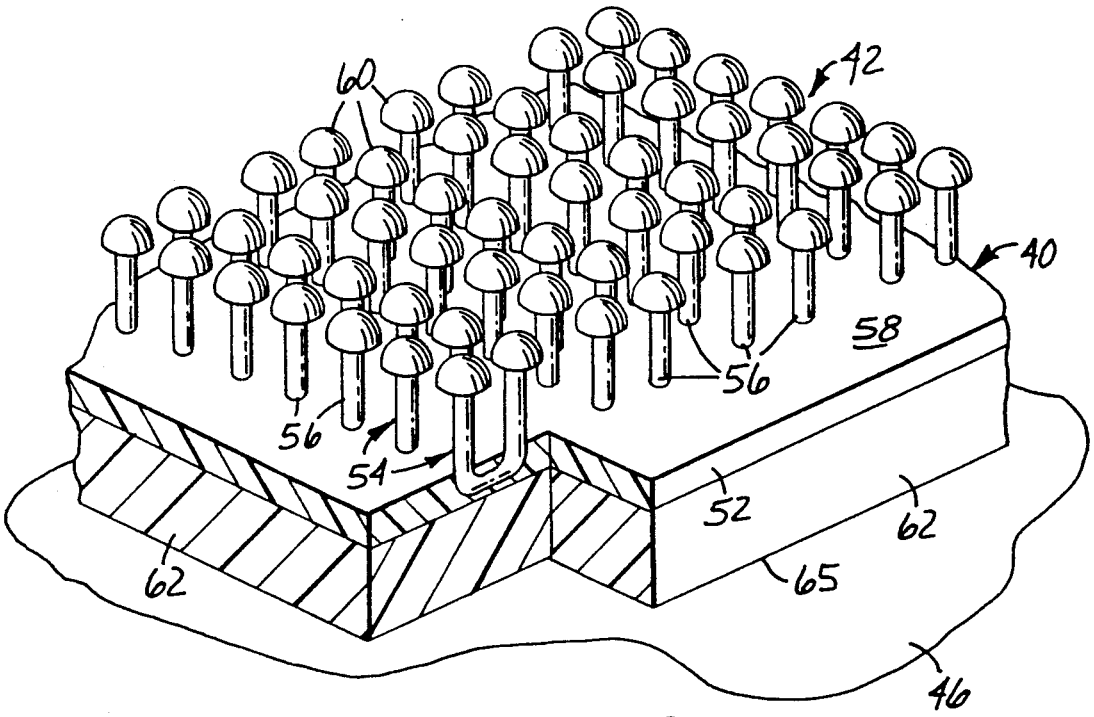
FIG. 2 is a fragmentary perspective view of a second embodiment of a strip material according to the present invention.

Referring now to FIG. 2 of the drawing there is shown a portion 40 of a second embodiment of an elongate strip material 42 according to the present invention, which portion 40 is illustrated adhered to the surface of an object 46 by pressure sensitive adhesive means so that the portion 40 can serve as part of a fastener attaching a second object (not shown) to the object 46. The portion 40 is highly transparent when viewed from an angle at which an exposed major surface 58 of a bonding layer 52 included in the strip material 42 can be seen after the portion 40 of the strip material 42 is adhered to the object 46 so that the color or colors of the object 46 will be fairly clearly seen through the portion 40 of the strip material 42.

The strip material 42 comprises the bonding layer 52 which is of highly transparent material and in which are embedded a plurality of highly transparent, flexible, resilient, generally U-shaped monofilaments 54. The monofilaments 54 have stem portions 56 that project from the exposed major surface 58 of the bonding layer 52 and have heads 60 at their distal ends. Also, the strip material 42 includes a layer 62 of highly transparent viscoelastic material adhered directly to a primed surface (see U.S. Pat. No. 4,563,388 incorporated herein for a preferred primer) of the bonding layer 52 opposite the exposed major surface 58 and having an attachment surface 65 opposite the bonding layer 52, and pressure sensitive adhesive means along the attachment surface 65 and provided by the adhesive nature of the layer 62 of viscoelastic material for adhering the strip material 42 to a substrate such as the object 46.

The adhesion properties of the layer 62 of viscoelastic material when that layer is made of the acrylic material commercially designated "Scotch VHB 4910" is not as good on all surfaces as the the adhesion properties of the acrylic adhesive commercially designated "Scotch Brand A-35 Adhesive Transfer Tape F-9752PC" used in the layer 20 of transparent pressure-sensitive in the strip material 12, however, a layer 62 of that material provides adhesion properties with many surfaces that are very acceptable.

An example strip material 42 was made of the same materials described above with respect to corresponding portions of the strip material 12 and tested as follows. The light transmittance through the example transparent strip material 42 was tested compared to the light transmittance through clear glass, both when the transparent strip material 42 laid on top of the glass, and when the transparent strip material 42 was adhered to the surface of the clear glass by the layer 62 of viscoelastic material. The percentage transmittance was obtained by integration of a scan completed on a Beckman Spectrophotometer UV 5240, over the wavelengths of visible light, 300 to 805 nanometers. Although visually there was a distinguishable improvement in the ability to see through the transparent strip material 42 when the strip material 42 was adhered to the glass, there was no increase in transmittance through the transparent strip material when it was adhered to the glass (the ratio of the radiant flux transmitted by a specimen to the radiant flux incident on the specimen). The transparent strip material 42 had a transmittance of 53.7%, as compared to a transmittance through clear glass of 90%. The transparent strip material 42 therefore had about 60% of the light transmission of clear glass. Transparent strip materials that have at least 50% the light transmission of clear glass should provide the advantages of the present invention.

The example of the strip material 42 was then tested by an opacity test outlined in ASTM 2805-88. In that test the reflectance of a sample over a black background and the reflectance of the same sample over a white background are both measured, and a ratio of those reflectances is calculated to determine the opacity of the sample. Those reflectances for the example transparent strip material 42 were measured both when the sample transparent strip material 42 was laid on top of the black and white backgrounds, and when the sample transparent strip material 42 was adhered to the black and white backgrounds by the layer 62 of viscoelastic material. This was done by 10 nm weighted ordinate method tristimulus integration of reflectance values to arrive at the tristimulus X,Y,Z values using a Hunterlab Labscan II Spectro Colorimeter available from Hunter Associates Laboratory, Inc., 11495 Sunset Hills Road, Reston, Virginia, 22090. Those values simulate the color matching response of a human observer as defined by the 1964 CIE 10 degree Standard Observer. Opacity was then calculated as Y black backing / Y white backing. Using this technique, the opacity of white paper was measured as 81.93%, the opacity of a transparent 0.05 millimeter (0.002 inch) thick polyester liner was measured as 0.50%, and the opacity of a 0.889 centimeter (0.035 inch) thick layer of the acrylic viscoelastic material commercially designated "Scotch VHB 4910" (i.e., the material used in the layer 62 of transparent viscoelastic material) when adhered to the black and white backgrounds was measured as 0.68%. Using this technique, the opacity of the sample transparent strip material 42 when laid on top of the black and white backgrounds was 37.34%, and the opacity of the sample transparent strip material 42 adhered to the black and white backgrounds by the layer 62 of viscoelastic material was 16.50% indicating that adhering the sample transparent strip material 42 to a surface reduced its opacity by 56% so that that surface could be much more easily seen through the strip material 42. The opacity of about 37% of the sample transparent strip material 42 when laid on top of the black and white backgrounds would not be acceptable for use as the present invention, however, transparent strip materials that when adhered to a surface have opacities determined by the above method of less than about 25% should provide the advantages of the present invention.

The present invention has now been described with reference to two embodiments thereof. It will be apparent to those skilled in the art that many changes and modifications can be made in the embodiments described without departing from the scope of the present invention. The pattern in which the stems are disposed in the bonding layer can be any of the patterns described in the documents described in the Background portion of this specification, or the pattern described in a U.S. Patent Application filed concurrently herewith that describes a strip material similar to that described in U.S. Pat. No. 4,290,174, modified to provide both a desired level of engagement and disengagement forces between two portions of the strip material while restricting relative movement between the engaged portions in directions parallel to the bonding layers in that (1) the bight portions are disposed in generally straight longitudinal rows parallel to the first direction with about 10 to 90 percent (and preferably about 30 to 70 percent) of the adjacent longitudinal rows being spaced center to center in a direction normal to the first direction by a first dimension that is less than a maximum dimension equal to the diameter of the heads plus the diameter of the stems so that slippage of the heads longitudinally of the strip material between these closely spaced rows will be restricted, and with the rest of the adjacent longitudinal rows being spaced center to center in a direction normal to said first direction by a first spacing dimension that is greater than said first maximum dimension, and (2) the bight portions are disposed in rows transverse to the first direction with the bight portions in each row being disposed in a zig-zag (e.g., sinusoidal) pattern deviating in each direction parallel to the first direction about an imaginary center line normal to the first direction with the deviation in each of the two directions being in the range of one half of the head diameter to one half of the sum of the head diameter plus the stem diameter, and with about 10 to 90 percent (and preferably about 30 to 70 percent) of the center to center distances between the stems along each longitudinal row, including the distances between stems extending from the opposite ends of the bight portions and the distances between the adjacent stems on adjacent bight portions along said longitudinal row, being less than a second maximum dimension equal to the diameter of the heads plus the diameter of the stems plus said deviation so that slippage of the heads transversely of the strip material between the zig-zag rows will also be restricted, with the rest of the center to center distances between the stems along each longitudinal row being spaced by spacing dimensions that are greater than said second maximum dimension, those spacing dimensions being selected in combination with the first spacing dimension to help provide a desired level of engagement and disengagement forces between the portions. Thus the scope of the present invention should not be limited to the structure described in this application, but only by structures described by the language of the claims and the equivalents of those structures.

We claim:

1. A strip material from which a portion may be severed and used as a portion of a fastener, said strip material comprising a polymeric bonding layer; a multiplicity of flexible, resilient, generally U-shaped monofilaments, each monofilament including a central elongate bight portion embedded in the bonding layer, two stem portions extending from the opposite ends of said bight portion and projecting generally normal to an exposed major surface of the bonding layer, and enlarged heads at the ends of said stem portions opposite said bight portion, a layer of viscoelastic material having a thickness in the range of about 0.052 to 0.152 centimeter adhered to the surface of the bonding layer opposite said exposed major surface and having an attachment surface opposite said bonding layer, and pressure sensitive adhesive means along said attachment surface for adhering the strip material to a substrate, and the combination of said bonding layer, said monofilaments, said layer of viscoelastic material and said pressure sensitive adhesive means being highly transparent when viewed from an angle at which the exposed major surface of the bonding layer can be seen after the strip material is adhered to a substrate by said pressure sensitive adhesive means so that the color of the substrate will be fairly clearly seen through the strip material after it is adhered to a substrate.

2. A strip material according to claim 1 wherein said strip material has at least about 50% the light transmission of clear glass measured by integration of a scan completed on a Beckman Spectrophotometer UV 5240, over the wavelengths of visible light, 300 to 805 nanometers, and wherein said strip material when adhered to a substrate by said pressure sensitive adhesive means, has an opacity of no greater than about 25% when measured in accordance with the test method outlined in ASTM 2805-88.

3. A strip material according to claim 1 wherein said strip material has at lease about 60% the light transmission of clear glass measured by integration of a scan completed on a Beckman Spectrophotometer UV 5240, over the wavelengths of visible light, 300 to 805 nanometers, and wherein said strip material when adhered to a substrate by said pressure sensitive adhesive means, has an opacity of no greater than about 16.5% when measured in accordance with the test method outlined in ASTM 2805-88.

4. A strip material according to claim 1 wherein said layer of viscoelastic material is a pressure sensitive adhesive and provides said pressure sensitive adhesive means along said attachment surface for adhering the strip material to a substrate.

5. A strip material according to claim 1 wherein said pressure sensitive adhesive means along said attachment surface for adhering the strip material to a substrate comprises a layer of pressure sensitive adhesive adhered along the attachment surface of said layer of viscoelastic material.

6. A strip material according to claim 1 wherein said layer of viscoelastic material has a thickness of about 0.089 centimeter.

* * * * *